United States Patent [19]

Reifferscheid

[11] Patent Number: 4,874,576

[45] Date of Patent: Oct. 17, 1989

[54] METHOD OF PRODUCING NODULAR CAST IRON

[75] Inventor: Karl J. Reifferscheid, Karben, Fed. Rep. of Germany

[73] Assignee: Metallgesellschaft Aktiengesellschaft, Frankfurt am Main, Fed. Rep. of Germany

[21] Appl. No.: 300,330

[22] Filed: Jan. 19, 1989

[30] Foreign Application Priority Data

Jan. 23, 1988 [DE] Fed. Rep. of Germany ..... 3801917

[51] Int. Cl.[4] ..... C22C 33/08

[52] U.S. Cl. ..... 420/22; 75/58

[58] Field of Search ..... 420/22; 75/58

[56] References Cited

U.S. PATENT DOCUMENTS

| | | | |
|---|---|---|---|
| 2,841,490 | 7/1958 | Steven | 420/22 |
| 3,415,642 | 12/1968 | Matsumoto | 75/58 |
| 3,467,167 | 9/1969 | Mahin | 75/46 |
| 3,955,973 | 5/1976 | Robinson | 420/22 |

FOREIGN PATENT DOCUMENTS

| | | |
|---|---|---|
| 61-15910 | 4/1986 | Japan . |
| 718177 | 11/1954 | United Kingdom . |

OTHER PUBLICATIONS

Published Lecture "Aus der Praxis des Sphärogusses" (Giesserei Publ. 1953).

Article "Metallurgical Applications of the Rare Earth Metals" (1969).

"Note Technique No. 48"-Fonte a Graphite Nodulaire (no date indicated)*.

"Industrial Applications of Rare Earth Elements" based on Symposium (1981)*.

"Investigation of Mechanism of Dross Formation . . ." (1970).

Search Report issued in priority appln. (38 01 917) filed in W. Germany and listing items marked * above, as well as other publications.

*Primary Examiner*—Peter D. Rosenberg

*Attorney, Agent, or Firm*—Herbert Dubno

[57] ABSTRACT

In a process of producing nodular cast iron wherein molten cast iron is treated in two stages with elements for inducing a formation of a predominantly nodular graphite, the crystallization of the graphite and the dynamic properties of the casting are improved in that a rare earth metal is added to the molten cast iron in the first treating stage and magnesium metal or a magnesium-containing master alloy in an amount which is sufficient for the formation of a predominantly nodular graphite is added to the molten cast iron in the second treating stage, in which no RE metal is added to the molten cast iron. The treatment is particularly effected with sheathed wires consisting of a steel sheath around a core of treating agent powder.

12 Claims, No Drawings

METHOD OF PRODUCING NODULAR CAST IRON

FIELD OF THE INVENTION

My present invention to a method or a process for producing nodular cast iron wherein molten cast iron is treated in two stages with elements for inducing formation of a predominantly nodular graphite in the cast iron.

BACKGROUND OF THE INVENTION

Three different processes of producing nodular cast iron are known in the art. The molten material is treated with cerium misch metal in one of the known processes, with magnesium in another and with calcium in a further process.

From U.S. Pat. No. 2,837,422 it is also known to treat molten cast iron with master alloys which, in addition to magnesium, contain rare earth metals. All cast iron products thus treated have improved mechanical properties and the treatment with magnesium is particularly desirable. A formation of nodular graphite in hypereutectoid and/or hypereutectoid melts will be achieved by a treatment with Mg and only in hypereutectoid melts by a treatment with cerium misch metal. Calcium dissolves only very slowly in cast iron (British Patent Specification No. 718,177).

It is known that the treatment of molten cast iron with magnesium will result in reactions of the magnesium with sulfur and oxygen with formation of sulfides and oxides of magnesium as reaction products, which form inclusions in the castings and lower their quality and cause scarred and unsound surfaces to be left on the castings. For this reason, it is also known to effect a desulfurization by a first magnesium treatment of the molten cast iron and after a reheating to effect a second treatment with magnesium to form nodular graphite.

However, since removal of the reaction products does not occur after the first treatment, the castings obtained from such melts have inclusions and surface defects ("Giesserei" 40, 1953, pages 93–103).

In the process disclosed in German Publication No. 21 43 521, a treatment with magnesium in two stages is effected and slag is removed after the first pretreatment. But, in that case, a reheating of the molten cast iron between the first and second treatments is required and must be tolerated.

In order to eliminate or avoid these disadvantages, it is known to use ceramic filters having an open-cell foam structure in the sprue system of a casting mold and to filter the molten metal. This treating step, however, significantly increases the costs of making the castings (European Patent Publication No. 0 126 847).

From Published Japanese Patent Application No. 61/15,910, it is known to treat high-sulfur cast iron with additives in two stages. An additive which contains rare earth metal is added in the first stage and a magnesium-containing additive in the second. The two additives may, alternatively, be added at the same time.

While the simultaneous addition of magnesium and rare earth metals is a simple and common process step, the rare earth metals thus added considerably contribute to the formation of reaction product slag (AFS Cast Metals Res. J., Sept., 1970, pp. 135/136).

It is also known to add mischmetal to a molten cast iron which has been treated with magnesium in order to avoid a slagging of the molten material by sulfur and oxygen and to oppose the disturbing effects of Ti, Pb, Sb, Bi, Al, Cu, As, Sn on the formation of nodular graphite ("Modern Casting", June 1969, pp. 94/95).

A slagging by sulfur may take place by a reoxidation of MgS with oxygen, which enters the system from the ambient atmosphere or in chemically unstable compounds by the reactions $$2MgS+O_2 \rightarrow 2MgO+2S$$

$$2S+2Mg \rightarrow 2MgS$$

As a result, sulfur is redissolved and causes the structural growth to degenerate. That reaction sequence is dependent on temperature and time and is described as "fading".

The progress of the above-mentioned reactions will be particularly promoted by turbulence occurring in the mold cavity during the casting operation. A particularly undesirable effect is produced by magnesium oxide slags appearing as segregation products in thick-walled castings, because such slags will result in abnormal structures by which the dynamic properties of the casting are seriously diminished.

Particularly, if the molten material to be cast has controlled low residual magnesium contents, the reaction mentioned above will result in a so-called resulfurization of the magnesium-treated iron after a few minutes so that the nodular graphite that has been found will be transformed to vermicular or flaky graphite and, therefore, the metallurgical goal of nodular graphite will be missed. In most cases, the temperature will have decreased so much that additional magnesium cannot be added and such addition would again result in a formation of detrimental reaction products of the known kind.

OBJECTS OF THE INVENTION

For this reason, it is an object of my invention, substantially, to prevent the formation of the above-mentioned reaction products of magnesium in the initial melt or to ensure that such reaction products will form only in such a fine dispersion that they will not disturb the structure, and thus to make castings which consist of nodular cast iron and have improved properties and sound and smooth surfaces.

DESCRIPTION OF THE INVENTION

In a process of producing nodular cast iron wherein molten cast iron is treated in two stages with elements for introducing a formation of a predominantly nodular graphite, this object is attained in the process in accordance with the invention in that for the production of cast iron having a high purity as regards nonmetallic inclusions (a) a rare earth metal (RE) is continuously added in the first treating stage as the molten cast iron is tapped so that oxygen and sulfur contained in the molten material are converted to finely dispersed nonmetallic phases of RE oxide, RE oxysulfide and/or RE sulfide (such as $Ce_2O_3$, $C_2O_2S$, CeS, $Ce_2S_3$) and (b) magnesium metal or a master alloy which contains magnesium is added in the form of a sheathed wire to the molten cast iron in the second treating stage in a quantity which is sufficient for a formation of a predominantly nodular graphite, whereas no RE metal is added in conjunction with the magnesium and the treated cast iron has a residual Mg content between 0.02 and 0.07% by weight and a residual S content between 0.005 and 0.025% by weight.

The molten cast iron is treated at relatively high temperatures above 1450° C. and preferably at 1500° C.

The addition of the RE metal to the molten cast iron before the treatment with magnesium required to produce nodular cast iron must be performed with special care to ensure that the RE metal will be distributed as uniformly as possible in the molten cast iron.

In the process in accordance with the invention, the molten material should be treated in the first stage with rare earth metals while the molten material from melting furnace at 1500° C. is flowing.

The solid particulate RE metal can be caused to flow into the pouring stream under manual control from a metering vessel as the molten cast iron is tapped from the furnace. But because the tapping takes only a few seconds, e.g. 45 seconds for 1000 kg of molten material, and the RE metal allow is added in an amount which is small relative to the amount of iron, a uniform introduction of the RE metal into the pouring stream may not be effected during the predetermined time.

The RE metal will be uniformly distributed if a fine-grained RE metal alloy is introduced by means of a vibrating trough. Fine-grained RE metal cannot be added at an exactly controlled rate (in grams per second) unless the particle size of the RE metal is within a narrow range, but this will increase the costs of producing the RE metal.

In a preferred, particularly reliable, reproducible and economical embodiment of the process, in accordance with the invention, the RE metal is fed as a wire into the pouring stream. The sheathed wire is fed into the pouring stream by means of a wire feeder (automatic feeder) so that the desired feed rate will reliably be achieved.

The means for controlling the automatic feeder permit a subsequent check of the treating operation. Besides, the use of the automatic feeder will reduce the accident risk and the inconvenience to the operator owing to radiant heat.

Alternatively, the RE metal can be introduced by means of submerged bells into the molten cast iron which has been tapped into a treating ladle. In all embodiments, the quantity of the RE metal which is added will depend on the analytically determined initial sulfur and oxygen contents of the molten material. The treating metal is suitably used in a small excess over that which is stoichiometrically required for reaction with this oxygen and sulfur.

The treating metal is desirably used as a master alloy based on ferrosilicon. It is preferred to use an RE metal alloy which is composed of 45 to 90% by weight cerium
5 to 35% by weight lanthanum
balance—other RE metals The RE metal is added to the molten cast iron on such a quantity that 10 to 150 ppm, preferably 20 to 60 ppm, RE metal remain in the finally treated cast iron.

Owing to the small quantity which is added, it may be desirable in the treatment to admix commercially available deoxidant alloys, such as calcium-silicon or ferrosilicon, to the rare earth metal so that the mixed alloy will be added and distributed as uniformly as possible during the tapping.

The treatment of the molten cast iron in the first stage is completed within a few seconds. The inspection of polished sections of samples which have been taken and permitted to cool will reveal that the nonmetallic phases consisting of oxygen and/or sulfur compounds of the RE metals, such as $Ce_2O_3$, $Ce_2O_2S$, Ces and $Ce_2S_3$, which have formed are perfectly uniformly and extremely finely divided in the matrix or are finely dispersed in the structure.

The RE oxysulfides and/or RE sulfides which have been formed by the pretreatment are more globular and their distribution in the matrix is intragranular so that they will not adversely affect the static and dynamic properties of the material that is to be produced. As a rule, the finely dispersed particles have a particle size of 1 to 2 μm. They act as nuclei for the crystallization of the graphite.

These phases are so fine that they cannot be removed if the molten cast iron that has been obtained in the first stage is filtered through a finely porous ceramic filter such as is conventionally used to filter Mg-treated cast iron. Besides, the use of a surplus of the treating agent will ensure that oxygen and sulfur will be virtually completely removed from the molten material. As a result, undesired reaction products of magnesium, particularly, MgS or MgO, will not be formed as a result of the succeeding treatment with magnesium in the second stage and the molten cast iron which has been treated need not be filtered.

The molten material which has been treated with RE metal in the first stage is treated in the second stage with magnesium in order to form a predominantly nodular graphite.

In order to utilize the desirably high temperature of the molten material, the treatment with magnesium in the second stage immediately follows the first treatment in that the cast iron which has been tapped into the treating ladle and has been pretreated with RE metal is treated with magnesium immediately thereafter. The molten material is at a temperature of 1470° to 1480° C.

The magnesium may be added to the molten material as magnesium metal, e.g. as a wire. Alternatively, the wire may consist of a sheathed wire, i.e. a wire having a steel sheath which envelops an interior core of powdered treating agent. The core may consist of magnesium powder or of a magnesium-containing mixed alloy powder. Such mixtures may contain powders of magnesium, iron, nickel, graphite and other components.

The magnesium used for the treatment in the second stage may alternatively be supplied as a lump master alloy based on ferrosilicon, copper or nickel.

It will be particularly desirable to use a nickel-magnesium master alloy which has a higher specific gravity than the molten iron. Such a master alloy may be composed, e.g. of 4 to 6% by weight magnesium
53 to 57% by weight nickel
balance—iron.

Alternatively, the magnesium may be added by the pour-over method, in which the magnesium master alloy is covered. In that case, the magnesium master alloy is placed at the bottom of the treating vessel and is covered with a covering material, such as steel punchings, and the molten material is poured thereon.

It will be understood that magnesium may alternatively be added by any other known method of addition, such as by means of a submerged bell, by blowing or by means of a tundish. Magnesium-containing sheathed wires are preferably used in the process in accordance with the invention.

For the process in accordance with the invention, it is essential that no RE metal is added during treatment with magnesium in the second stage, because excessive contents of RE metal in magnesium-treated cast iron would induce a formation of a chunky graphite. This is a most undesirable form of graphite, particularly where high-purity melts or high-nickel melts are used and where thick-walled castings of nodular cast iron are to be made.

In the two-stage process of treating cast iron in the production of nodular cast iron according to the invention, the treating agents may be introduced in the respective stages into the molten material in the same form or in different forms. For instance, the use of a submerged bell may be combined with a pour-over method or with a treating process using wire in the different stages. The treatment with sheathed wires is preferred in both stages of the process in accordance with the invention.

The two-stage treatment of the molten cast iron is followed by an inoculating treatment known per se, desirably with an inoculating alloy based on ferrosilicon.

Advantages are afforded by the process in accordance with the invention. The process in accordance with the invention permits the making of castings which are virtually free of inclusions and have sound and smooth surfaces and are free of abnormal structures so that they are also improved as regards their dynamic properties, such as elongation at rupture, reduction of area after fracture and fatigue strength. Besides, less magnesium is added and the molten material need not be filtered.

In a particularly simple, precise and reliable method, the alloying metals are introduced in the form of sheathed wires. In that case, there will be no need for special ladles and the treatment can substantially be automated. The inconvenience to the staff or operators caused by the heat will greatly be reduced.

SPECIFIC EXAMPLES

The invention will be explained in more detail and by way of example with reference to the following Examples.

The process in accordance with the invention, is particularly, suitable for making castings of nodular cast iron having a ferritic matrix. Properties defining the toughness of a material having a ferratic matrix, such as GGG 40, are the elongation at rupture and the reduction of area after fracture. In case of a base iron having a given analysis, the elongation at rupture and the reduction of area after fracture will depend, particularly of the wall thickness is large, on the shape, size and distribution of the nodular graphite in the ferratic iron matrix, on the ferrite grain size and on the residual pearlite content. Abnormal structures, such as segregation, intergranular precipitates and nonmetallic inclusions, will have a considerable adverse effect on the properties of the material.

It is also known in foundry practice that the static strength properties, particularly, the elongation at rupture, will decrease as the wall thickness increases. That relationship has been taken into account in the DIN 1693 standard specification for nodular cast iron.

In the making of a casting having a predetermined wall thickness, such as 200 mm, it must be taken into account that the as-cast castings will not be subjected to uniform cooling conditions. The temperature gradient will be more gentle at the thermal center of the cross-section of the casting than in outer wall portions. These different conditions of solidification will result in a degeneration of the graphite and in a segregation and formation of course grains in the cast structure so that the mechanical properties will be adversely affected.

Even in macroscopic examination, the grain structure at a fracture can be detected as a brittle fracture in many cases. In systematic examinations using a microprobe, it has been proved that the abnormal structures are due to reaction products of magnesium, such as magnesium oxide and magnesium sulfide. Because an improvement of the cast structure by an increase of the cooling rate as a measure of mold technology can economically be adopted only within certain limits, the possibility to improve the case structure by metallurgical measures is of special significance.

EXAMPLE 1

In an acid-lined, mains-frequency induction furnace having a capacity of 300 kg, a pig iron and deep-drawn sheet scrap were melted at 1450° C. together with electrode graphite as a carburizing agent and lump FeSi 75 as a siliconizing agent to produce a base iron having the following composition (in % by weight):

| C | Si | Mn | P | Ti | Cr |
|---|---|---|---|---|---|
| 3.60 | 1.35 | 0.12 | 0.030 | 0.02 | 0.03 |
| Cu | Ni | V | Pb | Sn | S |
| 0.02 | 0.01 | 0.01 | 0.002 | 0.002 | 0.010 |

(a) In a control experiment, a partial quantity, amounting to 100 kg, of the iron which had been overheated to 1460° C., was treated in a pour-over method with 1.4% of a commercially available master alloy composed (in % by weight) of 5.5% Mg, 1.8 Ca, 0.095% Al, 1.0% rare earth metals, 46.0% Si, balance Fe.

Before the pouring operation, the molten material was inoculated with 0.2% FeSi 70 in the pouring basin of the mold. A thickness sample taken from the molten material during the pouring operation had the following analysis (in % by weight):

| C | Si | S | Mg | Ce |
|---|---|---|---|---|
| 3.56 | 2.08 | 0.008 | 0.048 | 0.0051 |

(b) In an experiment carried out in accordance with the invention, the melting conditions for making the base iron were the same as before. A partial quantity, amounting to 1000 kg, of the base iron was again used. As that partial quantity was tapped from the melting furnace, 1 kg commercially available lump silicon misch metal composed (in % by weight) of 15.1% rare earth metals, 45.3% Si, 0.7% Al, 0.4% Ca, balance iron, was added to the pouring stream through a downcomer. The following treatment with Mg was effected with 1.4% by weight of a commercially available master alloy that contained 5.7% Mg, 2.1% Ca, 1.02% Al, 45.8% Si, balance Fe.

Inoculation and pouring were performed as in the control experiment (a). The sample had the following analysis (in % by weight):

| C | Si | S | Mg | Ce |
|---|---|---|---|---|
| 3.54 | 2.10 | 0.007 | 0.045 | 0.0054 |

After a metallurgical examination of the cast thickness takes, standard tensile test bars were made from the thermal center of the thickness take and used to determine the properties of the material. The results of said tests are apparent from Table 1. If only 0.015% rare earth metals are added before the treatment with magnesium, the elongation at rupture and the reduction of area after fracture were much higher for increasing wall thicknesses than in a conventional method in which 0.014% rare earth metals were added in a magnesium-containing master alloy.

That result is particularly apparent from the mathematical product $A_5$ x Z as a measure of ductility.

The difference which has determined in experiment (b) between the values for the elongation at rupture was proved also by the examination of polished sections waken from the tensile test specimens. The pretreated specimens contained more graphite nodules per $mm^2$ and less impurities at the grain boundaries than the control specimens obtained in experiment (a).

EXAMPLE 2

In an acid-lined mains-frequency induction furnace, a pig iron and deep-drawn sheet scrap were melted together with electrode graphite as a carburizing agent and lump FeSi 75 as a siliconizing agent to produce a base iron having the following composition (in % by weight):

| C | Si | Mn | P | Ti | Cr | Cu | Ni | S |
|---|---|---|---|---|---|---|---|---|
| 3.65 | 1.6 | 0.32 | 0.031 | 0.02 | 0.03 | 0.01 | 0.01 | 0.030 |

Three partial quantities (a), (b), (c) amounting to 25 kg each were tapped from that molten base iron and were treated with a magnesium master alloy and cast to form $Y_2$ specimens in accordance with DIN 1693. The three melts were treated with magnesium at a temperature of 1480° C. by means of a submerged bell containing a master alloy (FeSiMg 30), which contained 30.0 by weight Mg, 4.5% by weight Ca, 1.8% by weight Al, 6.9% by weight Fe, balance Si. After the treatment with magnesium, each of the three partial quantities of molten material was inoculated in the mold with 0.2% by weight FeSi 70.

(a) In a treating ladle, the partial quantity (a), amounting to 25 kg, was treated in a molten state with magnesium by an addition of 0.7% by weight FeSiMg 30. At the same time, a commercially available silicon misch metal (RE master alloy) as a standard material containing 15.1% by weight RE, 45.3% by weight Si, 0.7% by weight Al, 0.4% by weight Ca, balance Fe was added in an amount of 50 grams per 25 kg of molten material.

(b) In the second treating stage, a master alloy (FeSiMg 30) in a smaller quantity of 0.55% by weight was added to the partial quantity (b), amounting to 35 kg, when it was in a molten state. The RE metal was added in the first stage as a commercially available master alloy composed of 15.1% by weight RE, 45.3% by weight Si, 0.7% by weight Al, 0.4% by weight Ca, balance Fe. in an amount of 50 g per 25 kg of molten material, the master alloy was added to the molten material as it was tapped into the treating ladle before the treatment with magnesium.

(c) In the second treating stage, a master alloy (FeSiMg 30), also in a smaller quantity of 0.55% by weight, was added to the partial quantity (c), amounting to 25 kg, when it was in a molten state. The RE metal was added in the first stage as a commercially available master alloy composed of 32.0% by weight RE, 38% by weight Si, 0.9% by weight Al, balance Fe. That master alloy in an amount of 25 g per 25 kg of the molten material was added to the latter as it was tapped into the treating ladle.

It is apparent that the molten cast iron was treated with 0.03% by weight RE, corresponding to 8 grams per 25 kg of molten material in each of the foregoing experiments (a), (b), (c).

The analytical and metallographic results of the experiments of Example 2 are compiled in Table 2 and show that graphite in a satisfactory form was obtained in a ferrite-pearlite matrix from all three molten materials.

Although the master alloy was added to molten materials (b) and (c) in a smaller quantity of 0.55% by weight rather than 0.70% by weight, the residual magnesium contents obtained were unexpectedly high. In the process in accordance with the invention, that result has a high economical significant because the decrease of the amount in which the master alloy is added will more than offset the costs of the pretreatment of the molten material with rare earth metals.

The strength values determined from so-called proportional bars are compiled in Table 3. It is apparent that in case of an addition of the magnesium-containing master alloy in a smaller amount of 0.55% by weight rather than 0.70% by weight, the values for cast iron GGG 40 having a higher yield point and a higher tensile strength were above the lower limits specified in the standard whereas the molten material (a) treated in a single stage should not be used to produce a GGG 40 having an elongation at rupture above the lower limit.

TABLE 1

MECHANICAL PROPERTIES (as-cast state)

| Wall thickness mm | | Tensile Strength $R_m$ ($N/mm^2$) | Yield Point $R_{p0.2}$ ($N/mm^2$) | Elongation $A_5$ (%) | Reduction of Area Z (%) | Mathematical product as a measure of ductility $A_5 \times Z$ |
|---|---|---|---|---|---|---|
| 25 | (a) Addition of 0.14% rare earth metal with Mg master alloy | 423.2 | 280.2 | 19.0 | 17.5 | 332.5 |
| | (b) Addition of rare earth metal before the treatment with Mg | 419.5 | 271.4 | 21.0 | 22.4 | 470.4 |
| | Like (a) | 404.6 | 324.0 | 7.5 | 7.0 | 52.2 |

TABLE 1-continued

| Wall thickness mm | | MECHANICAL PROPERTIES (as-cast state) Tensile Strength $R_m$ ($N/mm^2$) | Yield Point $R_{p0.2}$ ($N/mm^2$) | Elongation $A_5$ (%) | Reduction of Area Z (%) | Mathematical product as a measure of ductility $A_5 \times Z$ |
|---|---|---|---|---|---|---|
| 200 | Like (b) | 410.8 | 290.8 | 16.0 | 16.5 | 264.0 |

TABLE 2

| | MOLTEN MATERIAL IN EXAMPLE 2 A | B | C |
|---|---|---|---|
| ALLOYING CONDITIONS | | | |
| First Stage | — | 0.03% RE | 0.03% RE |
| Second Stage | 0.07% FeSiMg 30 0.03% RE | 0.55% FeSiMg 30 | 0.55% FeSiMg 30 |
| S CONTENT BEFORE TREATMENT WITH Mg (% by weight) | 0.030 | 0.29 | 0.29 |
| ANALYSIS AFTER TREATMENT WITH Mg (% by weight) | | | |
| S | 0.010 | 0.009 | 0.009 |
| Mg | 0.039 | 0.042 | 0.044 |
| Ce | 0.0061 | 0.0055 | 0.0048 |
| Si | 2.2 | 2.1 | 2.1 |
| STRUCTURE IN $Y_2$ SPECIMEN | | | |
| Nodularity % | 90 | 90 | 90 |
| Ferrite | 55 | 65 | 50 |
| Pearlite | 45 | 35 | 50 |

TABLE 3

MECHANICAL PROPERTIES OF PROPORTIONAL BARS MADE OF $Y_2$ SPECIMENS (IN ACCORDANCE WITH DIN 50125)

| | MOLTEN MATERIAL IN EXAMPLE 2 A | B | C |
|---|---|---|---|
| Yield point $R_{p0.2}$ ($N/mm^2$) | 319/319 | 307/312 | 317/317 |
| Tensile Strength $R_m$ ($N/mm^2$) | 523/529 | 507/510 | 532/533 |
| Elongation at Rupture $A_5$ (%) | 11.0/13.5 | 15.5/15.7 | 16.5/17.5 |
| Reduction of Area After Fracture Z (%) | 10/11 | 14/14 | 15/15 |
| Brinell Hardness HB | 174/170 | 156/167 | 156/160 |

EXAMPLE 3

In an acid-lined mains-frequency induction furnace (e.g. with a mains or line frequency of 50 or 60 Hz) having a useful capacity of 6000 kg, pig iron, steel scrap and returns were melted together with electrode graphite as a carburizing agent and lump FeSi 50 as a siliconizing agent to produce a base iron having the following initial analysis (in % by weight):

| C | Si | Mn | P | Ti | Cr | Cu | Ni | S |
|---|---|---|---|---|---|---|---|---|
| 3.70 | 2.10 | 0.20 | 0.040 | 0.025 | 0.030 | 0.020 | 0.01 | 0.016 |

When the tapping temperature of 1530° C. had been reached, 600 kg of molten material were tapped into a preheated drum ladle (useful capacity 750 kg). After the tapping the molten material in the drum ladle was at 1495° C.

During the tapping operation taking 30 seconds, a steel-sheathed wire having an outside diameter of 5 mm was fed into the pouring stream at a velocity of 0.60 m/s by means of a wire feeder. The sheathed wire contained an RE metal alloy powder composed of 32.0% by weight RE, 38.0% by weight Si, 0.9% by weight Al, balance iron, in an amount of 40 g per meter of sheathed wire. In an amount of 600 g which had been calculated for the iron amounting to 600 kg, the RE metal alloy was fed into the pouring stream for 25 seconds during the tapping. This means that 15 m sheathed wire were fed into the molten material. The molten material was found to have a temperature of 1480° C. A sample was analyzed to have the following contents of C, Si and S (in % by weight):

| C | Si | S |
|---|---|---|
| 3.68 | 2.15 | 0.016 |

In the subsequent treatment of the molten material with magnesium to produce nodular cast iron, a sheathed wire was also used, which had an outside diameter of 9 mm. The steel-sheathed treating wire contained 33 g/m metallic magnesium powder and was fed at a rate of 20 m/min into the molten material which had been pretreated with an RE metal alloy. The feeding of wire in a length of 20 m took 60 seconds. As the filled sheathed wire had a weight of 225 g/m, 4.5 kg sheathed wire were added, corresponding to an addition of 0.75% based on the quantity of treated iron, amounting to 600 kg. A sample taken before the molten material was cast had the following analysis (in % by weight), from which the success of the treatment is apparent:

| C | Mg | S |
|---|---|---|
| 3.63 | 0.053 | 0.008 |

Portions of the molten material were cast to form $Y_2$ specimens in accordance with DIN 1693, on the one hand, and castings, on the other hand. In the making of specimens and castings, an inoculation with 0.15% FeSi 70 was effected only in the mold.

The $Y_2$ specimens and casting portions were subjected in an as-cast state to metallographic examinations, which revealed a satisfactory graphite formation comprising more than 90% nodular graphite in a ferritic matrix which contained 3 to 5% residual pearlite. So-called proportional bars made from $Y_2$ specimens and from castings were used to determine strength values, which fully complied with the requirements specified in DIN 1693.

The essential results of the treatment of molten cast iron with steel-sheathed wires in two stages for the production of nodular cast iron reside in that the quantity in which reaction product slags are formed during the treatment with magnesium is distinctly decreased and in that the iron which is produced in metallurgically "clean". Because a higher purity is obtained as regards nonmetallic inclusions and the quota of rejects consisting of castings having slag defects is decreased.

For instance, in commercial-scale tests using concrete castings which were made of nodular cast iron and had been cast in green sand molds, the quota of rejects having slag defects decreased from 6 to 8% to values of about 1%. From a metallurgical aspect, this may be explained in that the cerium oxysulfides formed owing to the addition of the RE metal alloy in the first treating stage are not affected by the treatment with magnesium metal so that magnesium sulfide will not be formed. Besides, complex reaction products, such as $MgOSiO_2$, $MgOCaO$, $MgOAl_2O_3$, will not be formed in the second treating stage because the treating agent does not contain silicon, calcium and aluminum.

I claim:

1. A method of producing nodular cast iron which comprises the steps of:

(a) forming a cast iron melt in a furnace;

(b) tapping said cast iron melt from said furnace in a stream into a receiver for said cast iron;

(c) continuously adding to said cast iron melt in said stream during the tapping of said cast iron melt and in a first treatment stage, a quantity of at least one rare earth metal in a form of steel-sheathed wire in an amount sufficient to convert oxygen and sulfur contained in the tapped melt to finely dispersed nonmetallic phases of rare earth oxide, rare earth oxysulfide and rare earth sulfide; and (d) thereafter adding magnesium metal to the tapped melt without rare earths in a second treatment stage, in a form of a steel-sheathed wire, and in an amount sufficient for the formation of predominantly nodular graphite in the cast iron upon solidification thereof, the amount of said magnesium metal added being sufficient to impart to the cast iron a residual magnesium content of substantially 0.02 and 0.07% by weight and a residual sulfur content of substantially 0.005 to 0.025% by weight.

2. The method defined in claim 1 wherein said magnesium metal is added in step (d) as elemental magnesium.

3. The method defined in claim 1 wherein said magnesium metal is added in step (d) as a magnesium-containing master alloy.

4. The method defined in claim 3 wherein said magnesium-containing master alloy has the following composition:

4 to 6% by weight magnesium,
53 to 57% by weight nickel, and
balance iron.

5. The method defined in claim 1 wherein at least one rare earth metal is added in step (c) in a quantity sufficient to provide substantially 10 to 150 ppm of rare earth in the cast iron following step (d).

6. The method defined in claim 1 wherein the rare earth metal is added in step (c) in the form of a master alloy containing at least one rare earth metal, iron and silicon.

7. The method defined in claim 1 wherein the rare earth metal is added in step (c) in the form of a master alloy of the following composition:

45 to 90% by weight cerium,
5 to 35% by weight lanthanum, and
balance rare earth metals other than cerium and lanthanum.

8. The method defined in claim 7 wherein said magnesium metal is added in step (d) as a magnesium-containing master alloy.

9. The method defined in claim 8 wherein said magnesium-containing master alloy has the following composition:

4 to 6% by weight magnesium,
53 to 57% by weight nickel, and
balance iron.

10. The method defined in claim 9 wherein the treatment in step (d) is effected immediately after the addition of the rare earth metal in step (c).

11. The method defined in claim 7 wherein the treatment in step (d) is effected immediately after the addition of the rare earth metal in step (c).

12. The method defined in claim 1 wherein the treatment in step (d) is effected immediately after the addition of the rare earth metal in step (c).

* * * * *